United States Patent [19]

Sarkisian et al.

[11] Patent Number: 4,919,609

[45] Date of Patent: Apr. 24, 1990

[54] CERAMIC TILE BURNER

[75] Inventors: Paul H. Sarkisian, Watertown; Frederick E. Becker, Reading, both of Mass.

[73] Assignee: Gas Research Institute, Chicago, Ill.

[21] Appl. No.: 346,588

[22] Filed: May 2, 1989

[51] Int. Cl.[5] ..... F23D 3/40; F23D 14/12

[52] U.S. Cl. ..... 431/7; 431/328; 431/329

[58] Field of Search ..... 431/329, 328, 326, 7; 126/92 R, 92 AC, 92 B

[56] References Cited

U.S. PATENT DOCUMENTS

| | | | |
|---|---|---|---|
| 3,421,860 | 1/1969 | Bottas | 431/329 X |
| 3,847,534 | 11/1974 | Nomaguchi et al. | 431/329 |
| 3,947,233 | 3/1976 | Sundberg | 431/328 |
| 4,608,012 | 8/1986 | Cooper | 431/328 |
| 4,657,506 | 4/1987 | Ihlenfield et al. | 431/329 |
| 4,752,213 | 6/1988 | Grochowski et al. | 431/328 |

*Primary Examiner*—Randall L. Green

*Attorney, Agent, or Firm*—Lorusso & Loud

[57] ABSTRACT

An improved gas-fueled ceramic tile burner capable of maintaining a stable flame at very high surface heat loading of a high porosity ceramic body. The improved ceramic tile burner includes a coarse steel mesh which is positioned abutting the downstream side of the ceramic body and upon which a pressurized mixture of air and fuel is ignited. The mesh helps to generate gas regeneration zones which stabilize the flame. Optionally, the disclosed ceramic tile burner has a secondary retaining mesh below the ceramic body which can be connected to the coarse steel mesh and to a burner housing in order to ground the meshes.

9 Claims, 2 Drawing Sheets

CERAMIC TILE BURNER

BACKGROUND OF THE INVENTION

This invention relates to ceramic tile burners of the type which are used in natural gas combustion systems as flame holders and flame spreaders.

Due to the increasing demand on manufacturers to make the most efficient use of space, it is often desirable to reduce the size of equipment. With gas-fired equipment using ceramic tile burners, use of ceramic tile burners with smaller surface areas can help in decreasing overall size of the equipment.

Ceramic tile burners are operated at a variety of specific heat release rates (surface heat loadings). At low surface heat loads, ceramic tiles act as radiant burners. Combustion of gaseous reactants passing through channels or pores of the ceramic tile takes place within the ceramic tile, and the tile becomes radiant. Ignition of the incoming reactants is caused by the high temperature of the ceramic and a flame holding capability is not needed.

At moderate surface heat loading rates, combustion takes place at or above the ceramic tile and the tile is cooled by the incoming reactants. In this regime, known as "blue flame" operation, the ceramic tile acts as a distributor, thermal barrier, and flame holder. Segments between the pores of the tiles cause turbulent recirculation zones to form, and this recirculation of hot gases ignites the combustion reactants as they exit the tile, keeping the flame stable. The ceramic tile. which is cooled by the reactants, effectively insulates the upstream reactants from the hot downstream combustion products, preventing flashback.

Increasing the surface heat loading capability of a ceramic tile burner to high levels, as required to maintain the same heat output while decreasing tile surface area, produces very high velocity reactant flow when low porosity tiles are used. This causes an unstable flame and noisy combustion. The unstable combustion also contributes to unacceptable high carbon monoxide levels. Experimentally, this phenomenon has been found to occur with low porosity (approximately 30% open) ceramic tiles at surface heat loading rates above about 3000 BTU/hr in$^2$. With high porosity ceramic tiles, channel wall thicknesses are small. This has a detrimental effect on the formation of downstream recirculation zones. For this reason, the flame holding capabilities of the tiles are poor, resulting in unstable combustion.

Accordingly, it is an object of the present invention to provide a ceramic tile burner that is capable of withstanding higher surface heat loadings than can known ceramic tile burners.

It is another object of the present invention to provide a ceramic tile burner that delivers the same heat transfer capacity as known ceramic tile burners while having a considerably smaller surface area.

It is yet another object of the present invention to provide a ceramic tile burner that can utilize a ceramic body of much higher porosity that can be used at high surface heat loadings by known ceramic tile burners while retaining flame stability and acceptable carbon monoxide levels.

It is still another object of the present invention to provide a high porosity ceramic tile burner which in spite of having extremely thin channel walls, still has adequate recirculation zones and flame holding capabilities.

SUMMARY OF THE INVENTION

Certain problems associated with known ceramic tile burners are avoided by the system of the present invention which is an improved ceramic tile burner having a high porosity and which is capable of stable operation at high surface heat loadings. Included in the burner is a coarse metal mesh abutting the downstream surface of the ceramic tile. The mesh serves as a secondary flame holder, facilitating the formation of turbulent recirculation zones. This is not possible with the ceramic tile alone due to the thin channel walls associated with the high porosity of the tile. As a result, the burner provides stable combustion in a high heat loading regime, permitting burner size to be reduced to as small as half that of a low porosity burner, while achieving similar heat output rates.

In a preferred embodiment of the invention a second metal mesh is mounted adjacent to the upstream surface of the ceramic tile. The second mesh acts as an additional support for the ceramic tile and may be connected to the primary mesh by wires passing through the pores of the tile and also connected to the burner housing to provide a ground for both meshes. Grounding of the primary mesh facilitates the use of a "flame current" type flame sensor with the sensing element positioned in close proximity to the ground so that current can pass from the flame sensor through the flame to ground.

BRIEF DESCRIPTION OF THE DRAWING

The invention is to be described in more detail with reference to the following figures of the drawing wherein like numbers refer to like elements.

DESCRIPTION OF PREFERRED EMBODIMENT

The invention is an improved ceramic tile burner having a highly porous ceramic mass and which operates stably at high surface heat loadings. The ceramic tile burner incorporates a coarse steel mesh which acts as a secondary flame holder and stabilizer. The coarse steel mesh is positioned to be upstream of the flame so that it is cooled by the flow of combustion reactants prior to their ignition.

Figure 1:
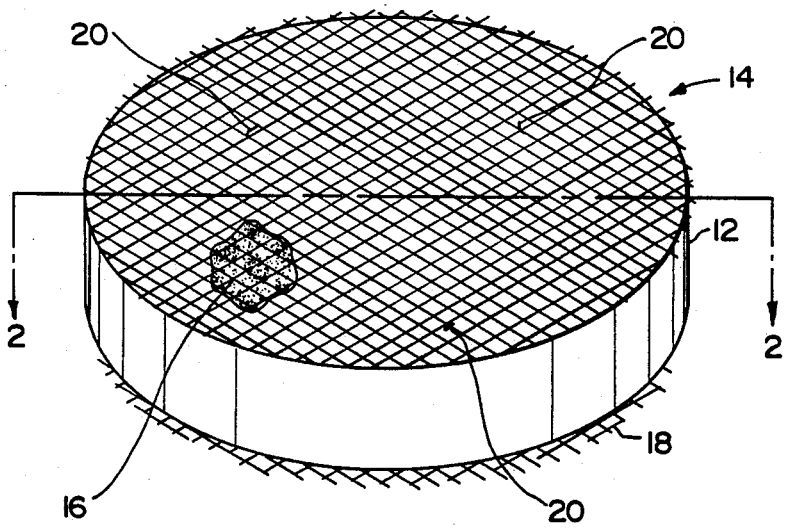
FIG. 1 is a perspective view of an improved ceramic tile burner in accordance with the present invention.
Figure 2:
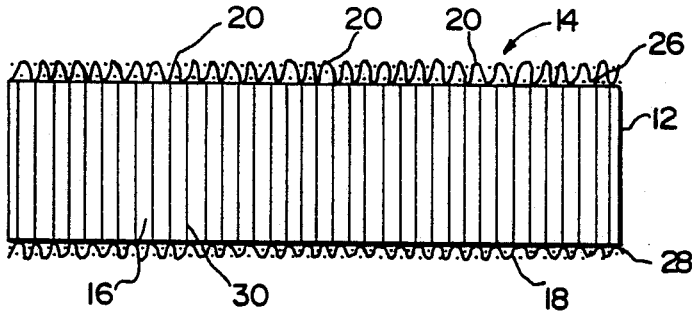
FIG. 2 is a sectional view of the ceramic tile burner in accordance with the present invention taken along line II—II of FIG. 1.

As illustrated in FIGS. 1 and 2, the ceramic tile burner in accordance with the present invention has as its main component a disc-shaped highly porous ceramic body 12. The ceramic body 12 typically has between 300 and 500 cells per square inch, preferably about 400. The individual cells or channels 16 each typically has a cross-sectional area of approximately 0.00175 in$^2$ resulting in an overall porosity of approximately 70% of the total surface area of the ceramic body 12. A preferred tile is a Corning Celcor ceramic tile having a diameter of 11¾ inches, a thickness of 1½ inches, and having approximately 400 channels per square inch. As was discussed earlier, known ceramic tile burners have not been able to operate successfully at high loadings with high-porosity due to flame instability. In the preferred embodiment of the invention, the highly porous ceramic body 12 is disc-shaped, but in alternate embodiments, the body 12 can be rectangular or any other reasonable geometric shape.

Positioned on the output surface 26 of the highly porous ceramic body 12 is a coarse metal mesh 14, preferably steel, which acts as a secondary flame holder and stabilizer. Because the mesh is constantly cooled by unignited gas reactants during operation, there is no need for this mesh to be formed of a high temperature material. A suitable mesh is constructed of 16-gauge (0.063 inch diameter) stainless steel wire in a 4×4 pattern (four wires per inch).

Figure 5:
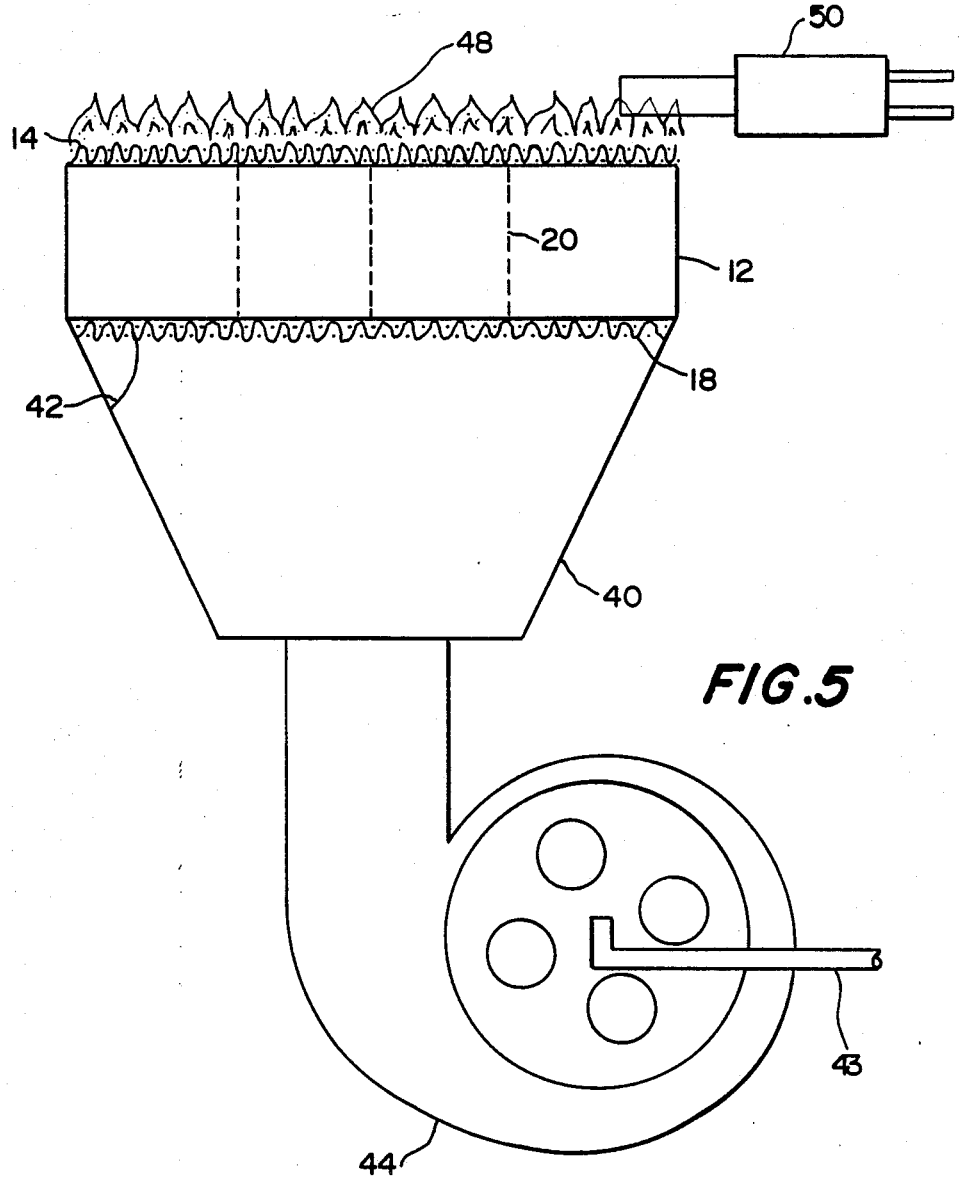
FIG. 5 is a side elevational view of a test arrangement including a ceramic tile burner in accordance with the present invention.

As is shown in FIGS. 1, 2, and 5, a second steel mesh 18 may be positioned to abut the input side 28 of the ceramic body 12 and in turn is connected to the burner housing 40 (FIG. 5) by a ground wire 42. The second steel mesh 18 is used to hold the ceramic body 12 in its operative position. Because this secondary mesh 18 is mounted on the input side 28 of the ceramic body 12, there is no need for it to be able to endure high temperatures because the burner flame is located on the opposite side of the ceramic body 12. Also, as the second mesh 18 is used primarily for support rather than for its flow distribution characteristics, it need not be constructed in accordance with any particular mesh size. It is only necessary that combustion reactants be able to flow in the direction of arrows 22 through the secondary steel mesh 18 to pass through the ceramic body 12.

As can be clearly seen in FIG. 2, which is a sectional view taken along line II—II of FIG. 1, channels 16 extend between the output surface 26 of the ceramic body 12 and an input surface 28. In one embodiment of the invention, wires 20 pass from the steel mesh 14, through the channels 16, to connect to the secondary retaining mesh 18. It is through the channels 16 also that a pressurized mixture of fuel gas and air is pumped from the input surface 28 to the output surface 26, after which the mixture is ignited on the mesh 14.

The walls 30 of the channels 16, by virtue of their end portions, constitute the solid portion of the input surface 28 and output surface 26 of the ceramic body 12. Due to the relatively high porosity of the ceramic body 12, the walls 30 are by necessity very thin. As a result, when a pressurized mixture of air and fuel gas is pumped from a natural gas supply line 43 into the input surface 28 of the ceramic body 12, as by a blower 44 (FIG. 5). the walls 30 would not by themselves form adequate recirculation zones upon egress from the output surface 26 of the ceramic body 12.

Figure 3:
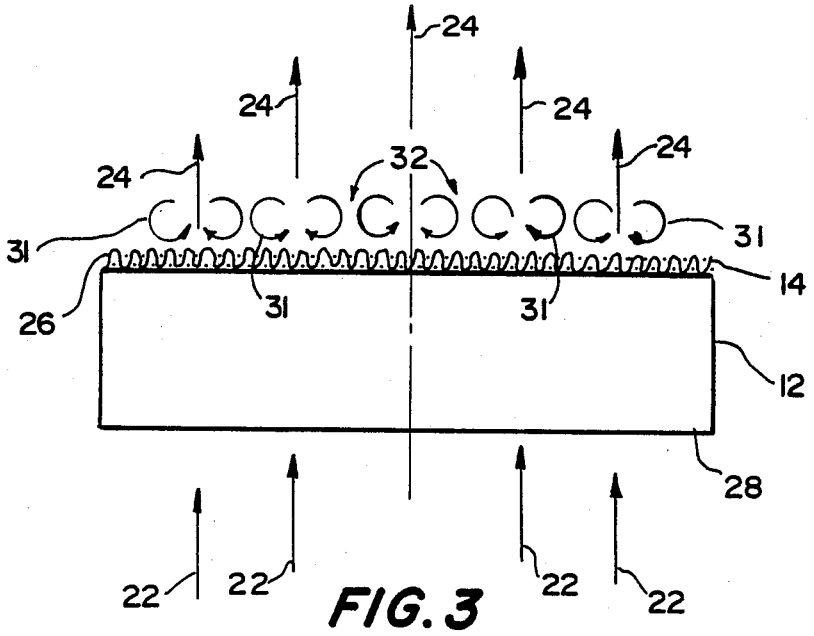
FIG. 3 is a side elevation view, partly in section, of a ceramic tile burner in accordance with the present invention schematically showing the generation of combustion gas recirculation zones.

The steel mesh 14, however, is able to compensate for the highly porous ceramic body's inability to generate adequate recirculation zones. As shown in FIG. 3, when combustion reactants are pumped in the direction of arrows 22 into the input surface 28 of the ceramic body 12, the reactants proceed through the channels 16 in the ceramic body 12 and egress through the output surface 26. At this point, the combustion reactants interact with the coarse steel mesh 14 resulting in turbulent flow as shown by the arrows 31 with the mesh 14 acting as a flame holder. This turbulent flow causes recirculation zones 32 to form and the resulting flame is stabilized on the upper, or downstream, portion of the mesh 14.

Figure 4:
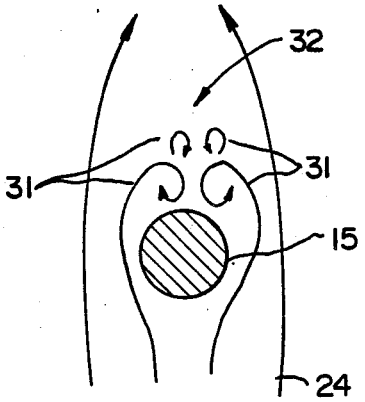
FIG. 4 is a schematic depiction of the turbulent flow of combustion reactants created by the flame stabilizing mesh of the present invention.

As depicted in FIG. 4, each wire 15 of the steel mesh interrupts the flow of the combustion reactants flowing in the direction of arrows 24. In the absence of these wires 15, the combustion reactants would proceed in streamline flow and there would be little to no recirculation of the combustion reactants. As shown in the figure, however, the wire 15 causes the combustion reactants to turbulently flow in the direction of arrows 31 to generate recirculation zones 32 which allow the ceramic tile burner of the present invention to maintain flame stability at higher surface heat loadings than known ceramic tile burners.

An important feature of the present invention is that the combustion reactants only ignite on the downstream side of the coarse steel mesh 14. One of the main benefits of this is that the coarse steel mesh 14 is constantly being cooled by the flow of the unignited combustion reactants which are cool relative to the resulting flame. As a result, the coarse steel mesh 14 has a long service life and requires little or no maintenance. Also, combustion of the reactants after they pass through the coarse steel mesh 14 achieves a more efficient and stable burning because the benefits of recirculation induced by the coarse steel mesh 14. Burners constructed in accordance with the present invention and operated in this manner have been able to generate stable flames using a ceramic body 12 with a porosity of over 70% and with surface heat loadings of up to 6500 Btu/hr in$^2$. Such loadings are over twice that which can be achieved with known ceramic tile burners.

In many applications in which ceramic tile burners are used, it is desirable to employ a flame sensor to monitor and help regulate the flame 48 resulting from the ignited combustion reactants (FIG. 5). In such applications the secondary steel mesh 18 can be especially beneficial if connected to the upper mesh 14 by the wires 20 and electrically grounded to the burner housing 40 with a ground wire 42. This ground connection is excellent for use with flame-current type flame sensors such as a combined ignitor/flame sensor 50 mounted above the coarse steel mesh 14. Since during burner operation the grounded mesh 14 is close to the sensor 50 with only the flame in between, a very efficient electrical circuit is formed.

Two compact heaters for heating brine solution were built using the above-described burner with high porosity tile and a stainless steel mesh abutting the upper tile surface. One heater was tested at firing rates between 531 KBTUH and 712 KBTUH and developed flue efficiencies between 81.6% and 82.7% with flue gas $CO_2$ levels between 7.05% and 9.45%. Observed CO levels were between 30 and 130 ppm. The other heater was tested at firing rates between 523 and 646 KBTUH. Flue efficiencies observed were between 83.0% and 83.5%; $CO_2$ levels between 7.35% and 9.00%; and CO levels between 0 and 70 ppm. Each heater showed stable, conical flames at the mesh flame holder over the range of operation. Without the wire mesh flame holder the heaters operated with an unstable flame, rumbling noises, and a very high exhaust gas CO level.

The embodiments described above are disclosed by way of illustration and not of limitation. Many other embodiments will be readily apparent to those skilled in the art without departing from the spirit and scope of the invention. The invention, therefore, is defined by the claims that follow.

What is claimed is:

1. A method of generating high specific heat output in a natural gas-fueled burner comprising:

providing a high-porosity ceramic body having an input surface, an output surface, and a multiplicity of channels substantially normal to said surfaces;

positioning a coarse metal mesh parallel to an abutting said output surface of said high-porosity ceramic body;

pumping a pressurized mixture of fuel gas and air through said high-porosity ceramic body from said input surface to said output surface;

generating with said coarse metal mesh turbulent flow of the pressurized mixture of fuel gas and air as it leaves the high-porosity ceramic burner;

igniting said pressurized mixture on said metal mesh to generate a flame; and allowing said coarse metal mesh to stabilize the flame resulting from the ignition of said pressurized mixture.

2. A method as set forth in claim 1 further including mounting said ceramic body in a burner housing, grounding said metal mesh by passing at least one wire through one of said channels of the ceramic body and connecting one end of the wire to said metal mesh and the opposite end to said burner housing, and monitoring said flame with a sensor spaced from said metal mesh.

3. A ceramic tile burner for natural gas combustion, comprising:

a burner housing;

a high-porosity ceramic body mounted in an opening defined by said housing, said ceramic body having an input surface and an output surface and defining a multiplicity of channels for passing a pressurized mixture of air and fuel gas from said input surface through said high-porosity ceramic body to said output surface for ignition downstream of said output surface;

blower means connected to said burner housing for supplying a pressurized mixture of air and fuel gas to said ceramic body; and a first coarse metal mesh positioned parallel to and abutting said output surface of said high-porosity ceramic body for generating turbulent flow of the pressurized mixture of air and fuel gas as it leaves said ceramic body and for acting as a flame holder and a flame stabilizer.

4. A ceramic tile burner as set forth in claim 3, further comprising a second metal mesh positioned to abut said input surface of said high-porosity ceramic body for supporting said high-porosity ceramic body in the burner housing.

5. A ceramic tile burner as set forth in claim 4 wherein said second metal mesh is electrically grounded to the burner housing and connected to said first steel mesh by electrically conductive wires passing through said channels in the high-porosity ceramic body.

6. A ceramic tile burner as set forth in claim 3 further comprising a flame sensor positioned near said first mesh, said first mesh being located between said ceramic body and said flame sensor.

7. A ceramic tile burner as set forth in claim 3 wherein said first mesh is formed of stainless steel.

8. A ceramic tile burner as set forth in claim 3 wherein said high-porosity ceramic body defines from about 300 to 500 channels per square inch of said output surface.

9. A ceramic tile burner as set forth in claim 3 wherein said high-porosity ceramic body includes at least about 400 channels per square inch of said output surface and the porosity of said ceramic body is at least about 70%.

* * * * *